US006394046B2

(12) United States Patent
Moller et al.

(10) Patent No.: US 6,394,046 B2
(45) Date of Patent: May 28, 2002

(54) FLUID COOLED CYLINDER LINER FOR A CYLINDER OF AN INTERNAL COMBUSTION ENGINE

(75) Inventors: Heribert Moller, Sachsen; Josef Winter, Rednitzhembach, both of (DE)

(73) Assignee: MAN Nutzfahrzeuge AG (DE)

( * ) Notice: Subject to any disclaimer, the term of this patent is extended or adjusted under 35 U.S.C. 154(b) by 0 days.

(21) Appl. No.: 09/864,550

(22) Filed: May 23, 2001

(30) Foreign Application Priority Data

May 23, 2000 (DE) ..... 100 25 527

(51) Int. Cl.[7] ..... F02F 1/10
(52) U.S. Cl. ..... 123/41.72; 123/41.83
(58) Field of Search ..... 123/41.72, 41.83, 123/41.74

(56) References Cited

U.S. PATENT DOCUMENTS 6,164,260 A * 12/2000 Bock ..... 123/193.2

* cited by examiner

*Primary Examiner*—Noah P. Kamen
*Assistant Examiner*—Katrina B. Harris
(74) *Attorney, Agent, or Firm*—R W Becker & Associates; R W Becker

(57) ABSTRACT

A fluid cooled cylinder liner for mounting in a cylinder of an internal combustion engine is provided. The fluid cooled cylinder liner includes a collar and a seal element. The collar has an outer circumferential surface dimensioned with respect to the inner circumference of the cylinder so as to be in substantially fluid sealing contact therewith, an annular cooling fluid channel formed radially inwardly of the outer circumferential surface, and a radial bore extending radially from the fluid channel through the outer circumferential surface and having one end communicated with the fluid channel and an opposite end communicated with a branch bore of the crankcase of the engine. The seal element substantially seals the interface between the branch bore of the crankcase and the radial bore of the collar of the cylinder liner against the leakage of cooling fluid.

3 Claims, 2 Drawing Sheets

FLUID COOLED CYLINDER LINER FOR A CYLINDER OF AN INTERNAL COMBUSTION ENGINE

BACKGROUND OF THE INVENTION

The present invention relates to a fluid cooled cylinder liner for a cylinder of an internal combustion engine.

DE 199 26 794 A1 discloses a cylinder liner for mounting in a cylinder, the cylinder liner having a collar in which a cooling water conduit is integrated and the collar having an outer circumferential surface operable as a sealing surface for sealing contact with the cylinder head. This publication does not describe an arrangement for circulating cooling water to and from the cylinder liner.

SUMMARY OF THE INVENTION

The present invention provides a cylinder liner for a cylinder of an internal combustion engine, which facilitates the installation and replacement of those components of the cylinder liner which are comprised in a cooling fluid circulation arrangement of the internal combustion engine.

The collar of the cylinder liner of the present invention is communicated with the circulating cooling fluid bores of the crankcase of the internal combustion engine through which cooling fluid is supplied to, and transported away from, the cylinder liner and the cylinder liner of the present invention offers particular advantages in connection with the re-furbishing or replacement of the sealing components involved in this circulation arrangement. While the refurbishment or replacement of sealing components of conventional wet cylinder liners requires the disassembly of the sealing components and the removal of the cylinder liners from their respective cylinders, the cylinder liner of the present invention permits refurbishment of a sealing component merely by removal of the deficient sealing component and installation of a new sealing component.

BRIEF DESCRIPTION OF THE DRAWINGS

The object and advantages of the present invention will be explained in more detail with the aid of the accompanying drawings, in which.

DETAILED DESCRIPTION OF THE PREFERRED EMBODIMENT

Figure 1:
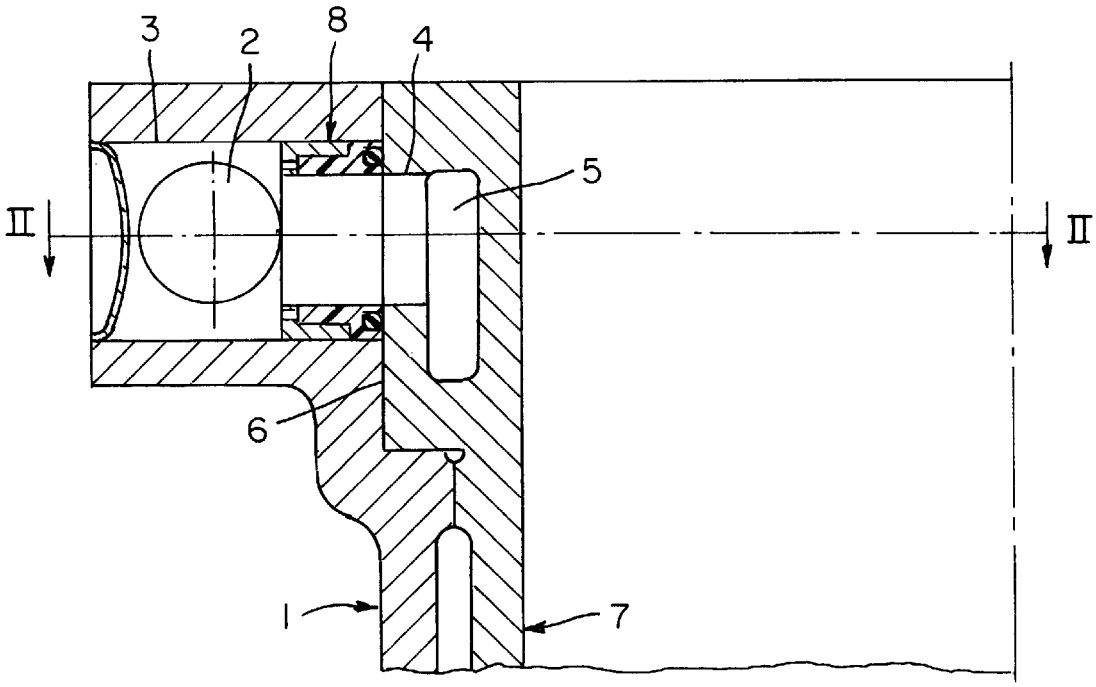
FIG. 1 is a vertical sectional view taken along a radial plane of a branch bore of a crankcase of an internal combustion engine and the thereto communicated radial bore of a collar of an embodiment of the cylinder liner of the present invention disposed in a cylinder of the crankcase.

FIG. 1 is a sectional view of a portion of the path of cooling water supplied within a crankcase 1 of an internal combustion engine to the cylinders in the crankcase. The illustrated cooling water path portion includes a longitudinal bore 2, a branch bore 3 extending transverse to the longitudinal bore 2 having one end communicated with the longitudinal bore 2 and an opposite end communicated with a radial bore 4 which extends radially from an annular cooling fluid channel 5 formed in a collar 6 of a cylinder liner 7. In view of the fact that the withdrawal of the cooling fluid from the cylinder liner 7 is accomplished by an identically configured arrangement, the cooling fluid discharge transport arrangement is not illustrated herein.

The cylinder liner 7 includes a seal element 8 for substantially sealing the interface between the branch bore 3 of the crankcase 1 and the radial bore 4 of the collar 6 of the cylinder liner 7 against the leakage of cooling fluid. The installation or, respectively, the configuration, of the seal element 8 is shown in FIGS. 2–5.

Figure 2:
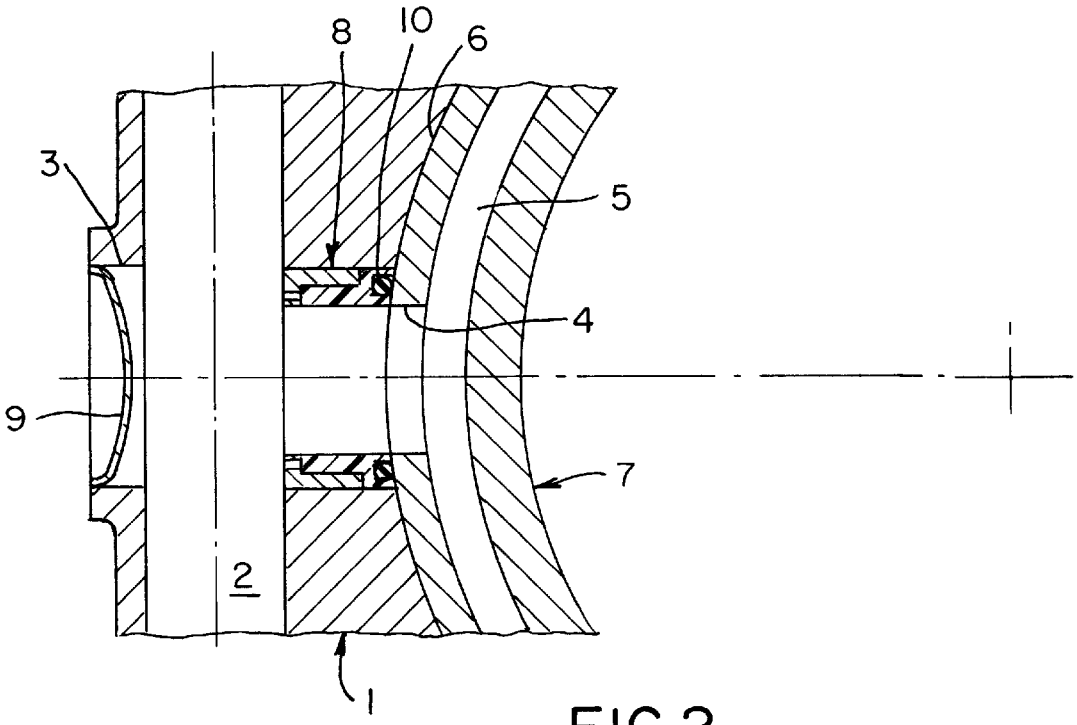
FIG. 2 is a top sectional view of the branch bore, the cylinder, and the cylinder liner shown in FIG. 1, taken along line II—II thereof.

FIG. 2 is a top sectional view, taken along line II—II of FIG. 1, of the installed disposition of the seal element 8 in the branch bore 3 of the crankcase 1. A cover 9 is provided to close an outside access to the branch bore 3. Cooling water flows through the longitudinal bore 2, turns into and flows through the branch bore 3, and thereafter flows through the radial bore 4 into the annular channel 5 in the collar 6 of the cylinder liner 7. An O-ring 10 is provided to prevent the leakage of cooling water from the interface of the branch bore 3 and the radial bore 4, the O-ring 10 being disposed in an annular groove formed in the seal element 8, as will be described in more detail hereinafter with reference to FIG. 3.

Figure 3:
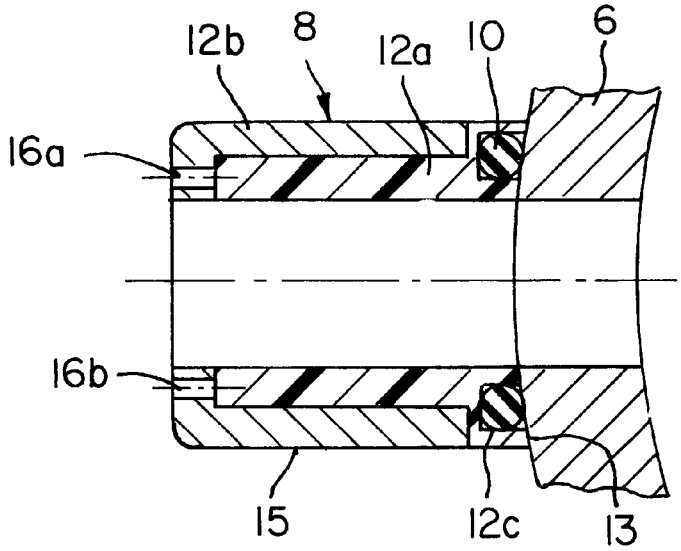
FIG. 3 is an enlarged top sectional view of the plastic injection molded sealing element of the cylinder liner shown in FIGS. 1 and 2.

As seen in FIG. 3, the seal element 8 is formed of plastic (polymeric material) and is formed by plastic injection molding. The seal element 8 is principally comprised of a hollow inner sleeve tube 12*a*, a hollow outer sleeve tube 12*b*, and the O-ring 10. The inner sleeve tube 12*a* has an end face 13, which is disposed against the outer circumferential surface of the collar 6 and is configured such that it follows the curvature of the outer circumferential surface of the collar. The inner sleeve tube 12*a* is communicated with the radial bore 4 and additionally includes an annular groove 12*c* formed in its end face 13 for receipt therein of the O-ring 10 such that the O-ring 10 is pressed into sealing contact against the outer circumferential surface of the collar 6. The geometry of the inner sleeve tube 12*a* permits a cost favorable mass production of the inner sleeve tube by plastic injection molding. The metal outer sleeve tube 12*b* encircles an axial extent of the inner sleeve tube 12*a* from the other end face of the inner sleeve tube 12*a* toward its end face 13. The outer sleeve tube 12*b* has a tube capping portion extending radially inwardly over the other end face of the inner sleeve tube 12*a*, and a pair of placement bores 16*a*, 16*b* formed in the tube capping portion. The placement bores 16*a*, 16*b* are adapted to receive therein respective projections of a placement tool which is deployed for placing the seal element 8 (see FIG. 2) in an orientation such that the one end face 13 of the inner sleeve tube 12*a* is mounted flush against the outer circumferential surface of the collar 6.

Figure 4:
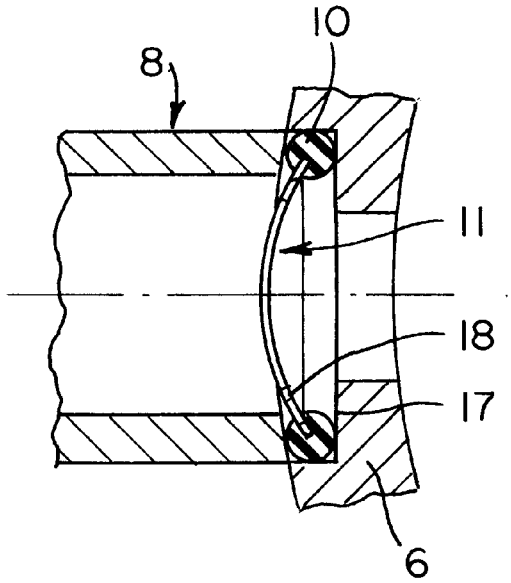
FIG. 4 is an enlarged top sectional view of the sealing element of another embodiment of the cylinder liner of the present invention, the sealing element including an O-ring sealingly pressed against an annular shoulder formed in the outer circumferential surface of the cylinder liner.

FIG. 4 shows another embodiment of the cylinder liner 7 of the present invention in which the seal element 8 is differently configured. The one end of the radial bore 4 communicated with the branch bore 3 of the crankcase 1 is formed as an annular portion 17 having a diameter greater than the cross sectional width of the other end of the radial bore 4 such that an annular shoulder is formed inside the radial bore 4 at the interface of the annular portion 17 and the therefollowing remainder of the radial bore 4. The seal element 8 includes an annular elastomeric sealing ring 10 operable to be sealingly seated within the radial bore 4 against the annular inside shoulder thereof, and a sealing disc 11 having a core body 18 whose outer circumference is encircled by the O-ring 10 and is integrally formed therewith by vulcanization. This configuration of the seal element 8 offers the advantage that it is easy to fabricate and does not require installation in any predetermined orientation relative to the axis of its movement into the radial bore 4 during assembly. A disadvantage of this configuration, to be sure, is that the formation of the annular portion 17 in the collar 6, even if only minimal, may weaken the collar.

Figure 5:
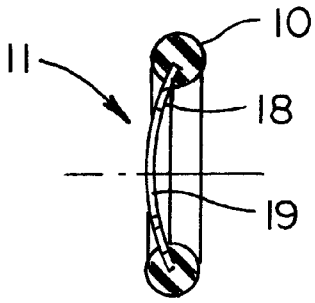
FIG. 5 is a top sectional view of the O-ring and the thereto attached core body.

FIG. 4 shows the sealing disc 11 in its installed disposition and FIG. 5 shows the sealing disc by itself. The sealing disc 11 includes the core body 18 vulcanized to the surrounding O-ring 10. The core body 18 has a contour accommodated to extend radially outwardly at most to the outer circumferential surface of the collar 6 of the cylinder liner 7 (see FIG. 4). A passage 19 is formed in the core body 18 for the flow therethrough of cooling water.

The seal element of the cylinder liner 7 of the present invention can be refurbished and/or replaced in the event of leakage of cooling water without the need to remove the cylinder head and disassemble the cylinder liner 7, as is needed with conventional cylinder liners.

With the cylinder liner of the present invention, it is merely necessary to disassemble or remove the deficient seal element 8 and replace the O-ring 10.

The specification incorporates by reference the disclosure of German priority document 100 25 527.2 of May 23, 2000.

The present invention is, of course, in no way restricted to the specific disclosure of the specification and drawings, but also encompasses any modifications within the scope of the appended claims.

What we claim is:

1. A fluid cooled cylinder liner for mounting in a cylinder of an internal combustion engine having a crankcase which includes a longitudinal bore and a branch bore extending transverse to the longitudinal bore having one end communicated with the longitudinal bore and an opposite end communicated with the cylinder, the fluid cooled cylinder liner comprising:

a collar having an outer circumferential surface dimensioned with respect to the inner circumference of the cylinder so as to be in substantially flush contact therewith, an annular cooling fluid channel formed radially inwardly of the outer circumferential surface, and a radial bore extending radially from the fluid channel through the outer circumferential surface and having one end communicated with the fluid channel and an opposite end communicated with the branch bore in the mounted position of the cylinder liner in the cylinder; and a seal element for substantially sealing the interface between the branch bore of the crankcase and the radial bore of the collar of the cylinder liner against the leakage of cooling fluid, whereby cooling fluid circulates in a substantially sealed manner in a circuit formed by the longitudinal bore and the branch bore of the crankcase and the radial bore and the annular fluid channel of the cylinder liner.

2. A fluid cooled cylinder liner according to claim 1, wherein the one end of the radial bore communicated with the branch bore of the crankcase is formed as an annular portion having a diameter greater than the cross sectional width of the other end of the radial bore such that an annular shoulder is formed inside the radial bore at the interface of the annular portion and the therefollowing remainder of the radial bore, and the seal element includes an annular elastomeric sealing ring operable to be sealingly seated within the radial bore against the annular inside shoulder thereof and a core body having an outer circumference encircled by the elastomeric sealing ring and forming a passage through which cooling fluid flows, the core body having a contour accommodated to extend radially outwardly at most to the outer circumferential surface of the collar of the cylinder liner.

3. A fluid cooled cylinder liner according to claim 1, wherein the seal element comprises an O-ring, a hollow inner sleeve tube preferably formed by plastic injection molding, and a hollow outer sleeve tube preferably formed of metal, the inner sleeve tube having an annular groove formed in one end face for receipt therein of the O-ring, the one end face of the inner sleeve tube being disposable against the outer circumferential surface of the collar such that the inner sleeve tube is communicated with the radial bore and the O-ring is pressed into sealing contact against the outer circumferential surface of the collar, wherein the outer sleeve tube encircles at least the other end face of the inner sleeve tube such that the outer sleeve tube, and the inner sleeve tube encircled thereby, are disposable as a unit in the branch bore of the crankcase, and wherein the outer sleeve tube has a tube capping portion extending radially inwardly over the other end face of the inner sleeve tube and a pair of placement bores formed in the tube capping portion, the placement bores for receiving therein respective projections of a placement tool which is deployed for placing the seal element in an orientation such that the one end face of the inner sleeve tube is mounted flush against the outer circumferential surface of the collar.

* * * * *